US005679279A

United States Patent [19]

Schmidgall

[11] Patent Number: 5,679,279

[45] Date of Patent: Oct. 21, 1997

[54] COLLAPSIBLE CORE SEAM COVER FOR CONCRETE MAKING APPARATUS

[75] Inventor: Jon A. Schmidgall, Mediapolis, Iowa

[73] Assignee: Hawkeye Concrete Products Co., Mediapolis, Iowa

[21] Appl. No.: 609,479

[22] Filed: Mar. 1, 1996

[51] Int. Cl.[6] ..... B28B 7/30; B28B 21/88

[52] U.S. Cl. ..... 249/83; 249/153; 249/178; 249/179; 425/110; 425/125; 425/438

[58] Field of Search ..... 425/110, 125, 425/438, 440, 441; 249/83, 152, 153, 178, 179, 183

[56] References Cited

U.S. PATENT DOCUMENTS 4,578,235 3/1986 Schmidgall et al. ..... 264/71
4,657,498 4/1987 Schmidgall et al. ..... 425/112
4,705,258 11/1987 Frei ..... 249/152
4,917,346 4/1990 Mathis ..... 249/153
5,139,404 8/1992 Grau ..... 425/111

*Primary Examiner*—James P. Mackey
*Attorney, Agent, or Firm*—James C. Nemmers

[57] ABSTRACT

A shield or cover combined with a collapsible core used in machines for making concrete pipe lined with a plastic liner. The cover is mounted on the outside of the core between the core and the liner and extends the full length of the seam between the stationary side and the moveable side of the core. The cover extends around the core a sufficient distance to prevent friction between the liner and the moveable portion of the core from pulling the liner out of the concrete as the core is collapsed.

9 Claims, 5 Drawing Sheets

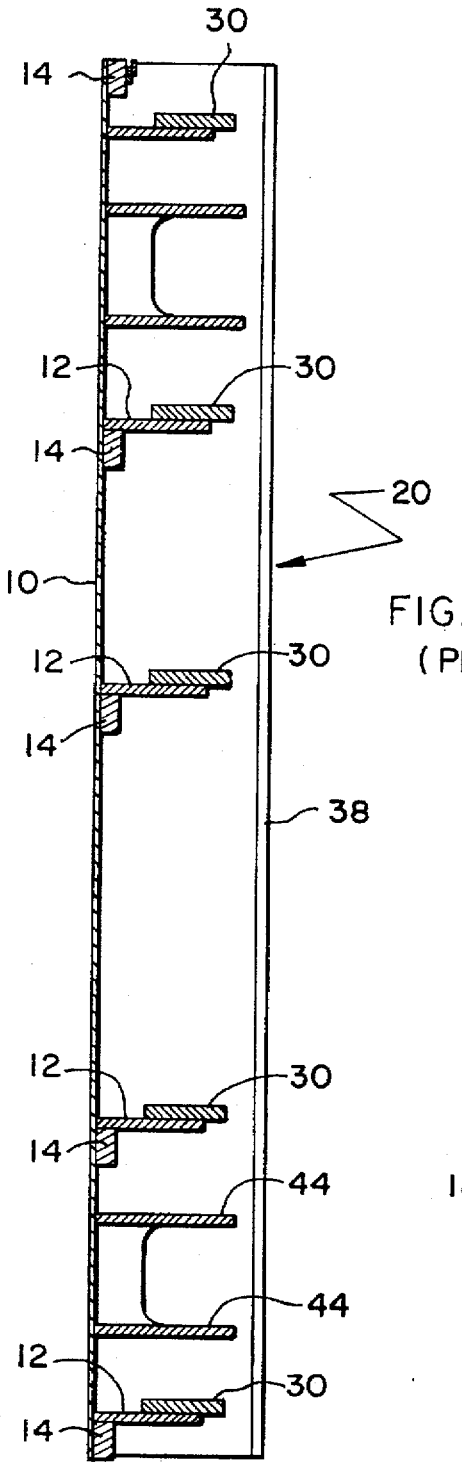
FIG. 4
(PRIOR ART)
FIG. 8
(PRIOR ART)
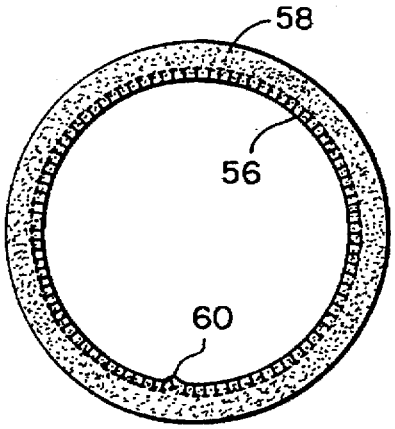
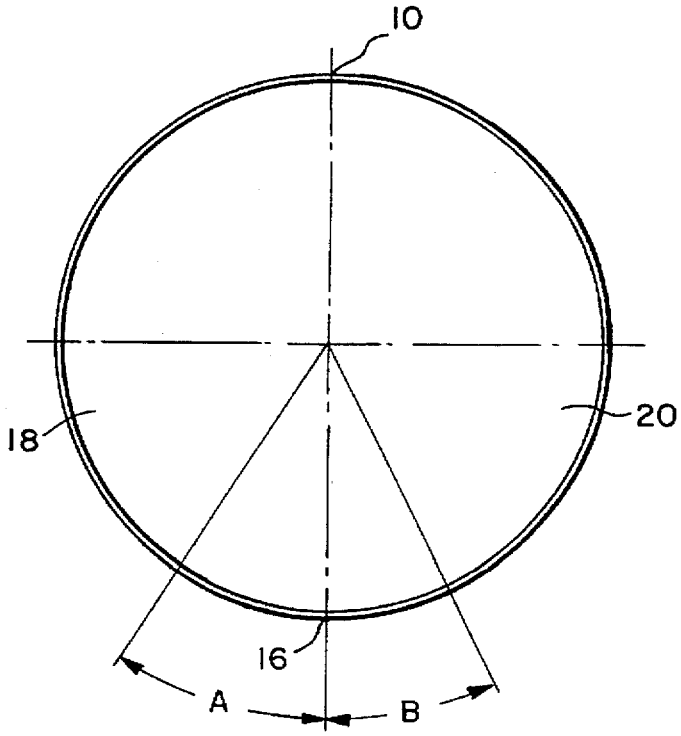
FIG. 10

COLLAPSIBLE CORE SEAM COVER FOR CONCRETE MAKING APPARATUS

BACKGROUND OF THE INVENTION

Concrete pipe are frequently manufactured with a plastic liner that provides increased resistance from corrosion and deterioration due to various chemicals contained in the liquids flowing through the pipe. The plastic material used for lining pipes is extruded in a sheet form and is provided with T-shaped ribs that project from one side. These T-shaped ribs are embedded in the concrete during the pipe making process, and when the concrete is set, an excellent bond is provided between the liner and the finished pipe. This bond is essential to prevent any inward bulging of the liner which can cause premature deterioration of the pipe, and therefore, any pipe containing a bulge is not acceptable for use. In some known pipe making methods, a proper bond between the liner and the concrete is created by wet casting the concrete around a liner supported by a core and jacket and then waiting a sufficient length of time for the concrete to cure before removing the core and jacket. Wet cast methods are effective and produce a pipe of acceptable quality, but wet casting is slow and therefore expensive. What is known as dry casting techniques are more commonly used in making concrete pipe, but when lined pipe is produced using dry casting techniques, it is not uncommon for the T-shaped ribs of the liner to pull out from the concrete and create a bulge. This "pull out" occurs because of the friction that is created between the liner and core when the core is removed. If a rigid non-collapsible core is used, friction between the core and liner is difficult to control and frequently will cause pull of the plastic liner and separation from the concrete pipe. Also, with a rigid non-collapsible core, it is difficult to place the liner over the core because these liners are large and flexible and preformed into a tube that must fit tightly over the core.

In an attempt to overcome the problem of "pull out" using rigid non-collapsible cores, collapsible and expandable inner cores have been used in the dry casting method. An example of a pipe making machine for making lined pipe using a collapsible core is shown in Grau U.S. Pat. No. 5,139,404. With these collapsible cores, the tubular liner is heated and slid over the core when it is in a collapsed condition. The core is then expanded to tightly grip the liner, the jacket portion of the concrete pipe form is positioned over and around the core and the concrete is poured into the space formed between the core and jacket. After the concrete is pressure headed, the core is immediately collapsed to prevent disturbing the plastic liner when off bearing the jacket containing the now-formed pipe. However, even when a collapsible core is used, friction is created between the plastic liner and the core during collapsing of the core, and this friction can cause the plastic liner to pull out or bulge along the core seam where the core is collapsed.

There are also other dry casting techniques used in making lined pipe, and examples of these are shown in Schmidgall et al U.S. Pat. Nos. 4,578,235 and 4,657,498. Although these other techniques have certain advantages, use of the collapsible core seems to be the preferred method.

In an attempt to minimize or prevent the bulging or pull out problems in dry casting methods using collapsible cores, some have used a narrow strip of relatively thin metal that is placed along and covering the core seam. This technique has minimized the bulging or pull out problem on some pipes some of the time. However, use of this narrow strip has not been consistently effective, and it adds to the labor cost in producing pipe since the strip must be repositioned each time a pipe is produced.

The prior art has also made other attempts at resolving the "pull out" problem when making lined concrete pipe using dry casting techniques by using multiple collapsible cores. With this technique, each core is transported along with the formed pipe to a curing area with the core left inside of the pipe until the concrete has initially set. The cores are then collapsed and removed. However, this system is considerably more expensive than the single core method because multiple collapsible cores must be available and the same overhead crane used to off bear the pipe is required to retrieve the cores.

There is therefore a need for an improved way of eliminating the pull out or bulging problems that occur in the manufacture of lined concrete pipe using the dry casting method. Any such improved way of producing lined concrete pipe must not only be consistently effective, but it must be relatively inexpensive and not slow down the pipe production process.

SUMMARY OF THE INVENTION

The invention provides a unique shield that is attached to a collapsible core and extends the full length of the seam between the stationary side and moveable side of the core. The cover of the invention includes a plate attached to the core lid, and the plate has a shield that extends downwardly the entire length of the core seam and is supported at the bottom of the core. The seam cover also extends around the core a sufficient distance to greatly minimize friction between the liner and the moveable portion of the core thus practically eliminating the pulling of the liner out of the concrete as the core is collapsed.

BRIEF DESCRIPTION OF THE DRAWING

FIG. 4 is a sectional view taken on the line 4—4 of FIG. 1;

FIG. 8 is a sectional view of a completed lined concrete pipe and illustrating a bulge;

FIG. 10 is a diagram illustrating the extent of coverage of the core seam by the cover of the invention;

DESCRIPTION OF THE PREFERRED EMBODIMENT OF THE INVENTION

The invention is applicable to the dry cast process well known to those skilled in the art of producing large concrete pipe and the like. In the dry cast process, a core is supported on a base and a jacket is lowered over the core to create an annular space between the core and jacket that is the form for the concrete pipe. After the concrete is poured into the form and a pressure head is brought down onto the form assembly to form the pipe, a crane is used to offbear the pipe from the core and the pipe is moved to a curing area.

When concrete pipe is to be produced with a plastic liner, a collapsible core is used so that the liner can be slipped over the core when in the collapsed condition after which the core is expanded and the customary process of forming the pipe is completed. Prior to off bearing, the core is collapsed to ease the off-bearing step. As explained in the background of the invention, it is during the collapsing of the core prior to off-bearing that the problem occurs because of friction created by the moveable portion of the core which will pull a portion of the liner inwardly creating a bulge. There are a number of designs of collapsible cores well known to those skilled in the art. The description that follows is for a collapsible core of a known design using an over-center lock mechanism for collapsing and expanding the core. There are of course other collapsible core designs and other methods of expanding and collapsing the core, and the following description of the collapsible core is illustrative and for the purposes of a better understanding of the invention.

Figure 1:
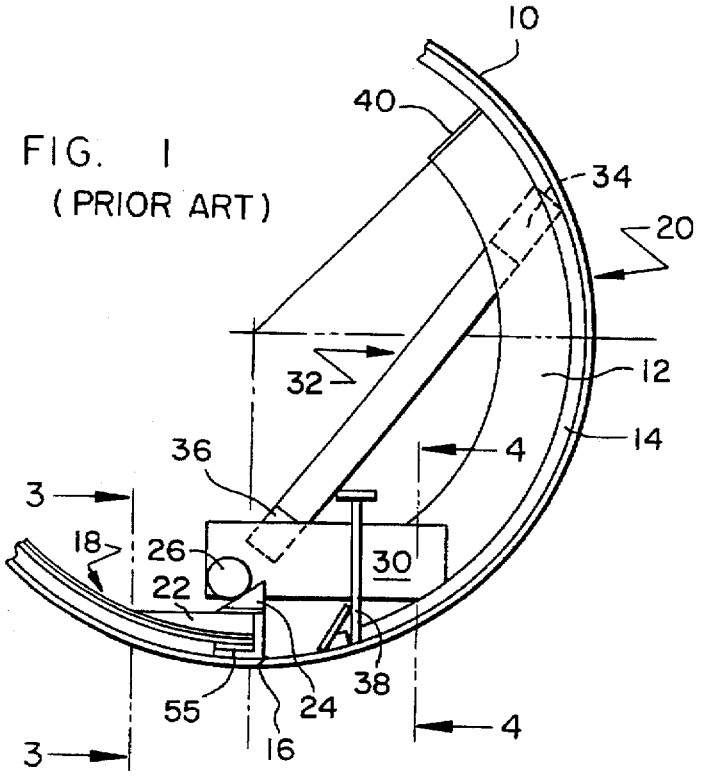
FIG. 1 (PRIOR ART)
FIG. 1 is the top view of a typical collapsible core with the lock mechanism not shown for purposes of clarity.
Figure 2:
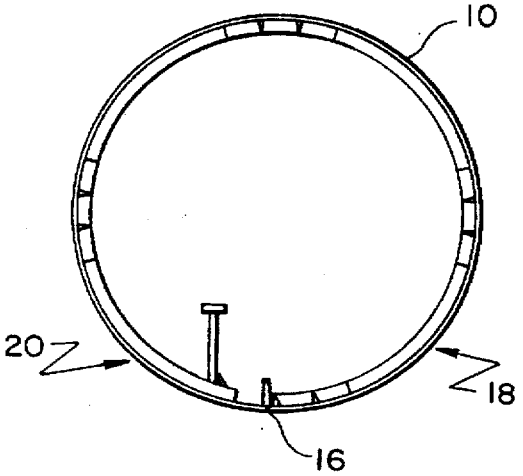
FIG. 2 (PRIOR ART)
FIG. 2 is a bottom view of the core of FIG. 1 with the lock mechanism not shown.
Figure 3:
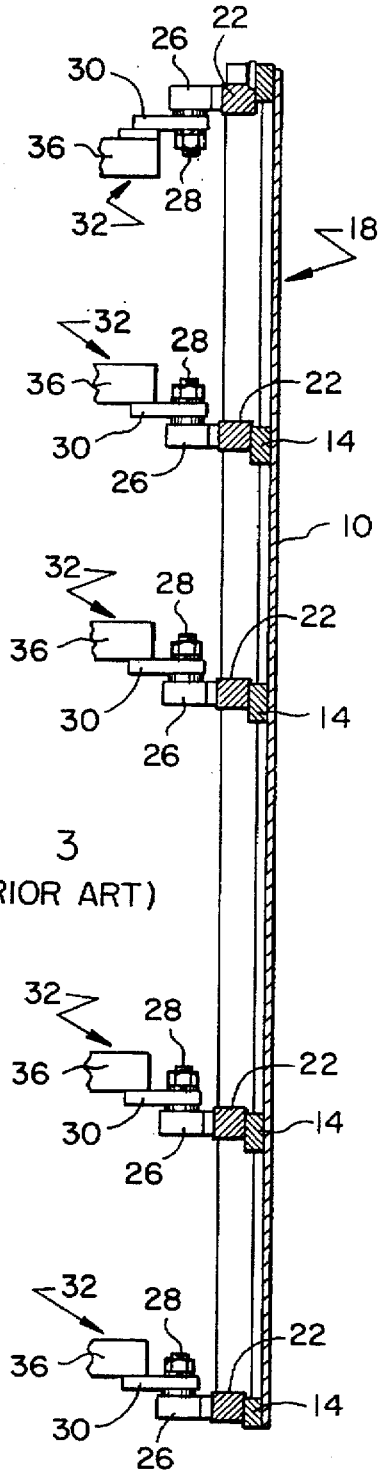
FIG. 3 (PRIOR ART)
FIG. 3 is a sectional view taken on the line 3—3 of FIG. 1 and showing a portion of the core.
Figure 5:
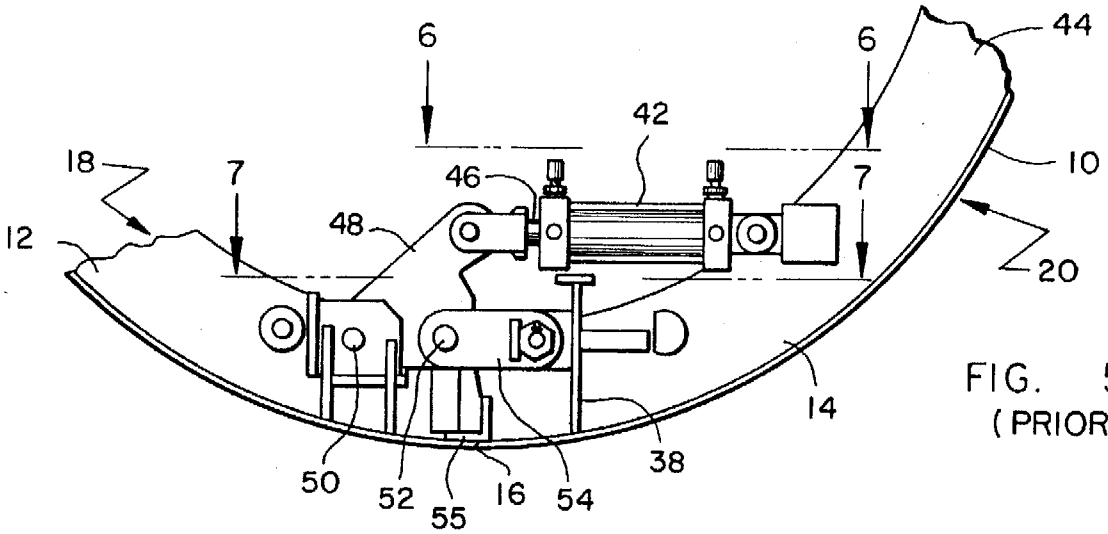
FIG. 5 (PRIOR ART)
FIG. 5 is a top view of a portion of the core of FIG. 1 and showing the lock mechanism at the lower end of the core.
Figure 7:
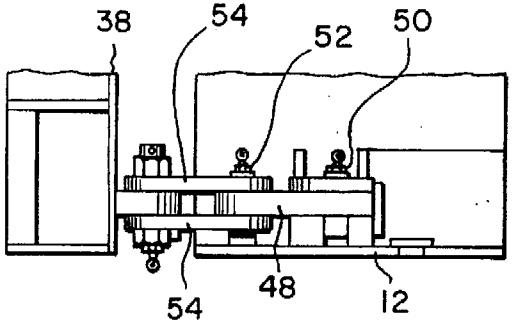
FIG. 7 (PRIOR ART)
FIG. 7 is a view taken on the line 7—7 of FIG. 5 and showing a portion of the lock mechanism.
Figure 6:
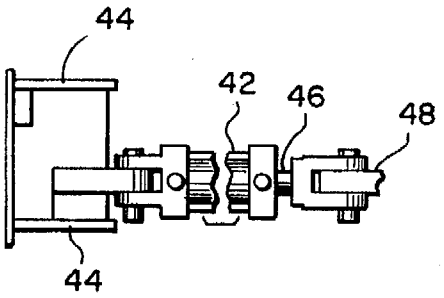
FIG. 6 (PRIOR ART)
FIG. 6 is a view taken on the line 6—6 of FIG. 5 and showing a portion of the lower lock mechanism.

Referring first to FIGS. 1–4, there are disclosed the basic elements of the collapsible core structure. FIGS. 1–4 show the basic core structure with the lock mechanism not shown for purposes of clarity. A basic lock mechanism is shown in FIGS. 5–7. The basic core includes a cylindrical shell 10 that has a plurality of rib segments 12 spaced axially along the inside of the shell 10. The shell is also strengthened by axially spaced apart rings 14, some of which are combined with the rib segments 12 and provide support for the ring segments 12 and other components of the core.

The shell 10 is cut at an angle longitudinally from top to bottom to form an overlapping seam 16, the edges of the shell 10 that form the seam 16 being beveled so as to overlap each other. The allows the edges to easily separte at the seam 16 when the core is collapsed but the seam 16 will positively close when the core is expanded to its full diameter as more fully described hereinafter.

The collapsible core has a moveable side 18 and a stationary side 20. With the mechanism described hereinafter, the moveable side 18 will be pulled toward the stationary side 20 and also will move inwardly to allow the moveable side 18 of shell 10 at the seam 16 to slip past the stationary portion of the shell 10 on the stationary side 20. To create this inward movement, there is welded or otherwise secured to each of the rib segments 12 a ramp supporting member 22 to which there is welded a ramp 24 that is engaged by a cam follower 26. Each of the cam followers 26 is mounted on a shaft 28 (FIG. 3) secured to a plate 30 that is in turn affixed to each of the rib segments 12 that are in turn welded to the rings 14. Tubes 32 are each in turn secured at one end 34 to the rib segments 12 while the free end 36 of each tube 32 rests on the corresponding plate 30 to serve as a guide and prevent any axial movement of the moveable side 18 of the core relative to the stationary side 20. As an additional support and stiffener, a T-shaped stiffening rib 38 extends from the top of the core on the stationary Side 18 to the bottom of the core (see FIGS. 1, 2 and 4). The rib 38 is welded to the ends of the rib segments 12 and rings 14 near the seam 16, while a second stiffener 40 (see FIG. 1) is welded to the other ends of the rib segments 12 and rings 14.

Referring now to FIGS. 5, 6 and 7, there is illustrated an over-center lock mechanism for the collapsible core. The mechanism shown is the lower lock mechanism mounted near the lower end of the core. However, it will be understood that a similar mechanism would be mounted at the top of the core as well with the two mechanisms simultaneously actuated. A hydraulic cylinder 42 is pivotly mounted on supporting ribs 44 that are affixed to the inside of the shell 10 on the stationary side 20. The operating rod 46 of the cylinder 42 is pivotly connected to one end of a cam plate 48. The other end of the cam plate 48 is pivotly secured by pivot 50 to a rib segment 12 at the bottom of the core on the moveable side 18. The third pivot point 52 of cam plate 48 is pivotly secured to a pair of vertically spaced apart links 54 which are in turn secured to the stiffening rib 38 on the stationary side 20 of the core. Thus, when the hydraulic cylinder 42 is actuated to extend the operating rod 46, the cam plate 48 will pull the moveable side 18 of the core toward the stationary side 20, and the moveable side 18 will also move radially inwardly because of the beveled edges of the shell 10 at seam 16. This action thus collapses the core. Conversely, when the hydraulic cylinder 42 is actuated to withdraw the operating rod 46, the linkage with the cam plate 48 will expand the core by moving the moveable side 18 outwardly and toward the stationary side 20 so that the seam 16 will once again be closed. A vertical guide bar 55 assures proper closing and alignment of the seam 16.

Figure 9:
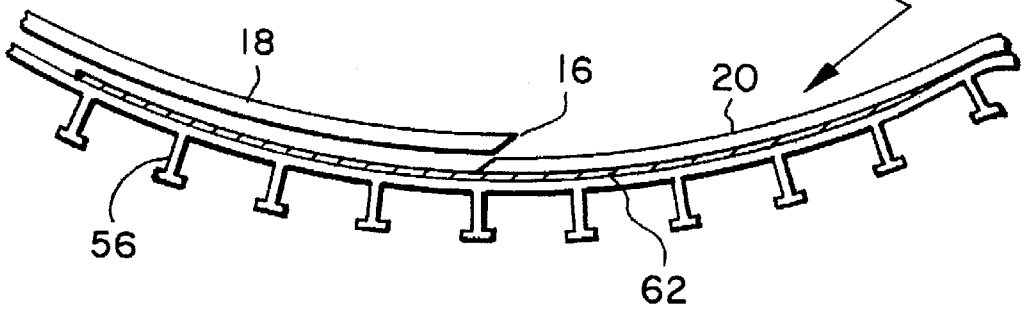
FIG. 9 is a sectional view of a portion of a liner, core and the cover of the invention.

Having thus described the basic construction and action of the collapsible core, it will be seen that the moveable side 18 of the core, starting at the seam 16, will slide toward the stationary side 20 and also move slightly radially inwardly to permit the edge of the shell 10 on the moveable side 18 to slip inwardly and bypass the edge of the shell 10 of the stationary side 20. With reference to FIG. 9, this action is illustrated schematically in a partial sectional view of that portion of the shell 10 near the seam 16. FIG. 9 also illustrates the T-shaped liner 56 as it would be positioned around the shell 10 of the core. As can be seen from FIG. 9, the portion of the shell 10 on the moveable side 18 moves inwardly and toward the stationary side 20, thus moving away from the liner 56. The friction created by this movement between the moveable side 18 of the shell 10 and the liner 56 can frequently pull the liner 56 out of the concrete pipe 58 and create a bulge 60. This is illustrated in FIG. 8 with the bulge 60 shown as being created near the seam 16 on the moveable side of the shell 10. FIG. 9 illustrates the cover of the invention positioned between the liner 56 and the shell 10 extending circumferentially outwardly from the seam 16. The cover is indicated generally by the reference numeral 62 and will now be described in detail.

The cover of the invention includes a curved shield 64, the curvature of which is such that it will be concentric with the shell 10 of the core. In other words, the concave inner surface of the shield 64 will conform to the outside surface of the shell 10. The shield is of relatively thin low friction material, such as metal, and of a length to cover the entire length of the seam 16 from top to bottom of the shell 10. At the lower end of the shield 64 is a stiffening ring 66 that add rigidity to the shield 64 and also serves as a means for securing guide tabs 68 to the bottom of the cover 62. These tabs 68 extend downwardly from the lower edge of the stiffening ring 66 at each side of the cover 62 and serve to properly center the cover 62 on the core support block 70. In addition, an inwardly extending tab 72 is attached to the guide tab 68 on the stationary side 20 of the core so that it will extend under the bottom edge of the shell 10 to prevent the cover 62 from lifting up once installed on the core.

Figure 14:
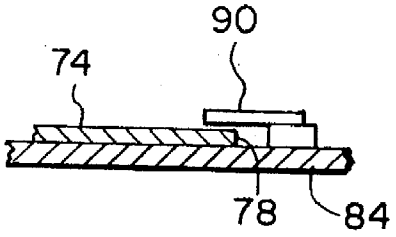
FIG. 14 is a sectional view taken on the line 14—14 of FIG. 12.
Figure 12:
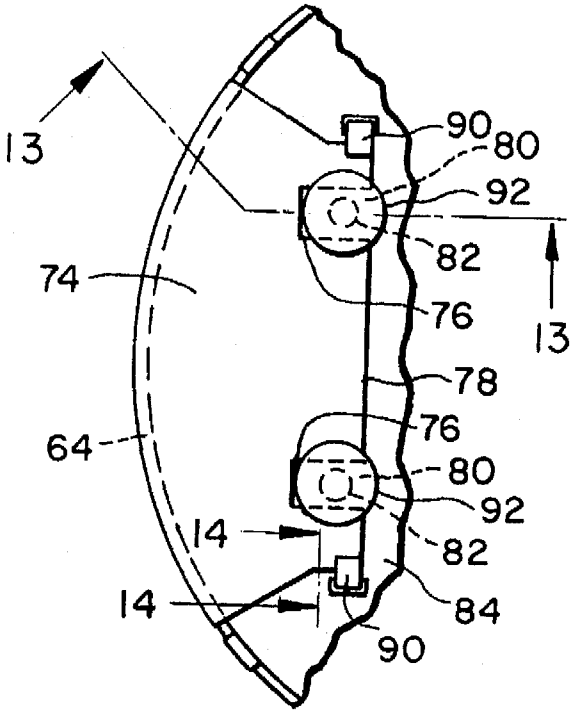
FIG. 12 is a top view of the cover of the invention and showing a portion of the core lid with the cover installed on the lid.
Figure 13:
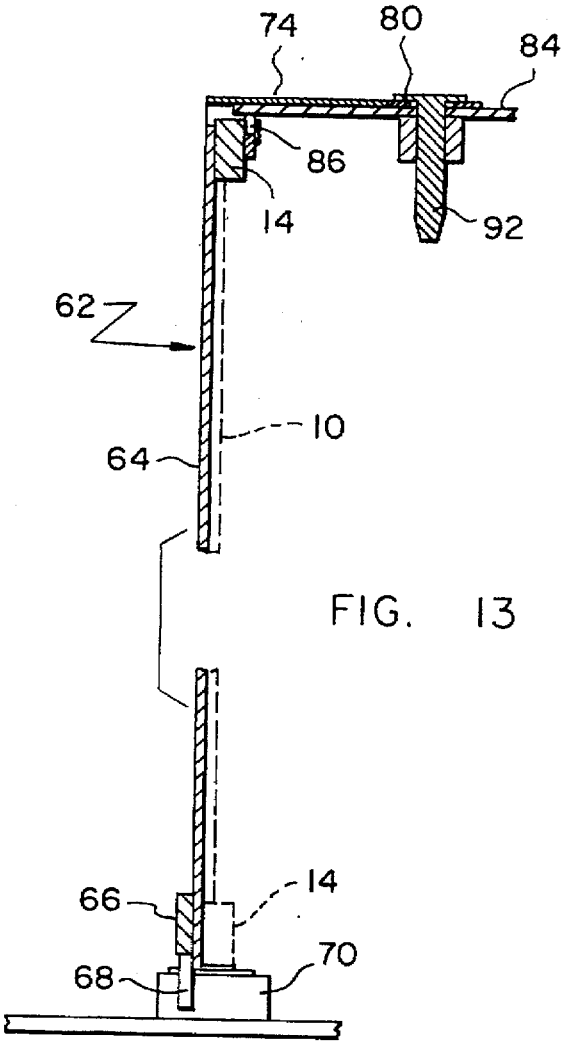
FIG. 13 is a sectional view of the cover of the invention taken on the line 13—13 of FIG. 12.
Figure 11:
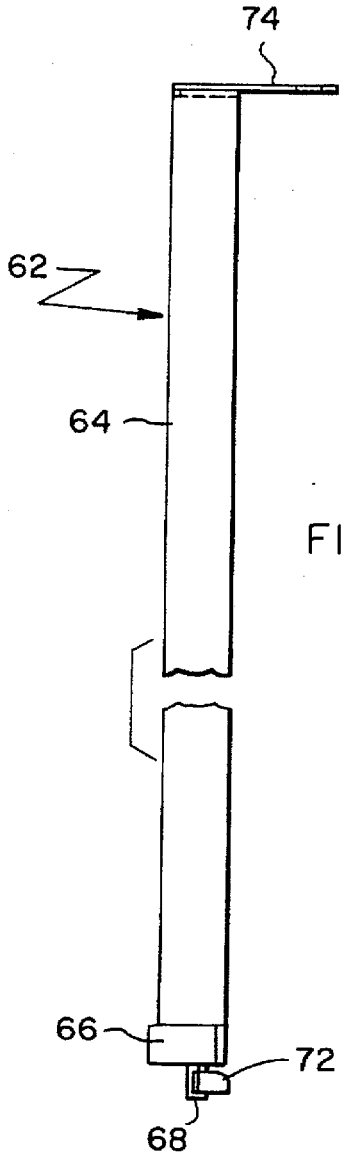
FIG. 11 is a side elevational view of the cover of the invention.
Figure 15:
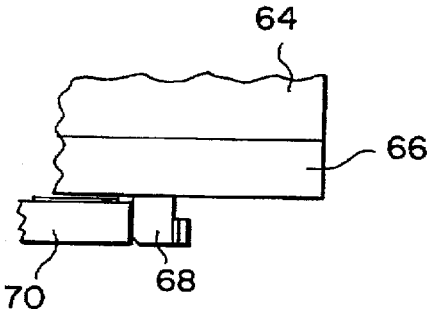
FIG. 15 is a front elevational view of a portion of the lower end of the cover of the invention.

At the top end of the shield 64 is a plate 74 welded at right angles to the shield 64 and extending inwardly from the shield 64. As best seen in FIG. 12, the plate 74 is provided with a pair of rectangular shaped notches 76 at the inner end 78 of the plate 74. Notches 76 will fit around correspondingly shaped tabs 80, each of which has an oblong shaped opening 82 formed in it. As is well known to those skilled in the art, the core has a lid 84 which rests upon an annular rubber seal 86 affixed to the inside of and extending upwardly from the upper ring 14 (see FIG. 13). The core lid 84 has holding tabs 90 (see FIG. 14) spaced from and secured to the upper surface of the core lid 84 which tabs 90 receive the plate 74 as it is slipped over the core lid 84 thus holding the cover plate 74 in place. Once in place, tabs 80 are slipped into the notches 76 of the cover plate 74 and welded in place. A locking pin 92 is then inserted through each of the openings 82 into a corresponding opening in the core lid 84, thus securely locking the cover 62 in place.

With the cover 62 in place, it will be evident that the seam 16 is completely covered by the cover 62, and when the liner 56 is slipped over the core shell 10, the liner 56 will also be slipped over the cover 62. After the concrete pipe is poured, and the core collapsed, movement of the moveable side 18 of the core will not create any friction against the liner 56 in the area of seam 16 since the cover 62 is positioned between the liner 56 and the portion of the moveable side 18 of the core that creates the problem. The off bearing step in which the pipe 58 is removed from the core can now take place without the danger of any bulge being formed in the liner 56. The core will then remain in its collapsed condition to facilitate another liner being slipped over the core in preparation for formation of the next concrete pipe.

The circumferential distance of the outside surface of the shell 10 that is covered by cover 62 is somewhat critical. In FIG. 10, there is a diagram in which the area covered by the cover 62 is determined by two central angles, Angle A and Angle B. Angle A is the angle between the radius extending through the seam 16 and the radius extending to the outside edge of the shield 64 on the moveable side 18. Angle B is the angle between the center line through the seam 16 and the radial line which extends to the outside edge of the shield 64 on the stationary side 20 of the core. The following chart illustrates the sizes of Angles A and B for various core outside diameters, and shows the corresponding width of the shield 64 for the different size cores:

| OUTSIDE DIAMETER OF CORE | ANGLE A | ANGLE B | SHIELD WIDTH |
|---|---|---|---|
| 39" | 34.5° | 34.5° | 24" |
| 48" | 32.4° | 25.2° | 24" |
| 54" | 32° | 32° | 30" |
| 60" | 33° | 25° | 30" |
| 66" | 31.5° | 31.5° | 36" |
| 72" | 33° | 24.9° | 36" |
| 78" | 30.4° | 21.7° | 36" |

It is noted that the minimum angle of Angle A on the moveable side 18 of the core is slightly more than 30°, while the minimum angle for Angle B is almost 22°.

It will be evident from the foregoing description that the invention provides a relatively inexpensive but effective way of greatly minimizing pull outs and bulges in liners used in the manufacture of lined concrete pipe. The cover of the invention can be added to standard existing collapsible cores, and thus can be retrofitted to existing pipe making machines in the field. Obviously the cover of the invention can also be produced and added to newly manufactured collapsible cores. The shield greatly minimizes the cause of the pull outs and bulges in plastic lined concrete pipe, and any remaining friction created between the liner and the collapsible core as the core is collapsed is greatly reduced. Since the cover of the invention once installed on the core can remain on the core during the time that the core is repeatedly used to manufacture concrete pipe, it eliminates the necessity of positioning a shield each time a pipe is being produced. Because the cover of the invention greatly minimizes pull outs and bulges in lined concrete pipe, it will quickly pay for the added cost of the cover.

Having thus described the invention in connection with the foregoing described preferred embodiments of it, it will be evident to those skilled in the art that various revisions and modifications can be made to the preferred embodiments described herein without departing from the spirit and scope of the invention. It is my intention, however, that all such revisions and modifications that are obvious to those skilled in the art will be included within the scope of the following claims.

What is claimed is as follows:

1. A cover for use in combination with a collapsible core supported on a core support block, the collapsible core being used in making lined concrete pipe by the dry cast process, the collapsible core having a cylindrical-shaped shell with a first side and a second side movable relative to each other to collapse the core and a core lid covering the top of the shell, the first and second sides of the shell being normally joined at an axially extending seam in the shell, the cover comprising: a curved shield of a length to extend from the top to the bottom of the shell and curved to fit closely against the shell, the shield extending circumferentially beyond the seam in the shell to cover a predetermined amount of the first side of the shell and a predetermined amount of the second side of the shell, a shield plate affixed at the top of the shield and extending inwardly from the shield, holding means combined with the core lid to hold the shield in place on the shell, and guide means at the bottom of the shield to properly position the shield relative to the shell seam.

2. The cover of claim 1 in which the first side of the shell is a stationary side and the second side of the shell is a movable side that is movable relative to the stationary side.

3. The cover of claim 2 in which the shield has a locking tab extending inwardly at the bottom of the shield, the locking tab being engageable with the bottom of the shell to prevent upward movement of the cover relative to the shell.

4. The cover of claim 3 in which the locking tab extends from the bottom of the stationary side of the shell.

5. The cover of claim 4 in which the guide means includes guide tabs extending downwardly from the bottom of the shield , one such guide tab being positioned on each side of the shield so as to engage the core support block and properly position the cover relative to the shell seam.

6. The cover of claim 2 in which the holding means includes one or more holding tabs on the core lid which holding tabs are engageable with the shield plate to prevent the shield from moving relative to the core lid and core shell.

7. The cover of claim 6 in which the holding means also includes a locking pin engageable with the core lid and the shield plate to hold the shield plate from movement relative to the core lid.

8. The cover of claims 2, 3, 4, 5, 6 or 7 in which the shield has a first outer edge and a second outer edge, and the shield extends circumferentially over the movable side of the shield a distance that is determined by the interior angle between a radial line from the center of the core to the shell seam and a radial line that intersects the first outer edge of the shield, the interior angle being at least 30°.

9. The cover of claim 8 in which the shield extends circumferentially over the stationary side of the shield a distance that is determined by the interior angle between a radial line from the center of the core to the shell seam and a radial line that intersects the second outer edge of the shield, the interior angle being at least 22°.

* * * * *